United States Patent [19]

Eddlemon

[11] Patent Number: 4,808,909

[45] Date of Patent: Feb. 28, 1989

[54] BIAS VOLTAGE AND CONSTANT CURRENT SUPPLY CIRCUIT

[75] Inventor: Dennis N. Eddlemon, Tucson, Ariz.

[73] Assignee: Apex Microtechnology Corporation, Tucson, Ariz.

[21] Appl. No.: 108,745

[22] Filed: Oct. 15, 1987

[51] Int. Cl.[4] ..... G05F 3/16

[52] U.S. Cl. ..... 323/313; 323/315

[58] Field of Search ..... 323/312, 313, 315

[56] References Cited

U.S. PATENT DOCUMENTS

| | | | |
|---|---|---|---|
| 3,820,007 | 6/1974 | Schilling et al. | 323/313 |
| 4,283,674 | 8/1981 | Kominami et al. | 323/313 |
| 4,290,005 | 9/1981 | Arumugham | 323/313 |
| 4,686,449 | 8/1987 | Jeffrey et al. | 323/313 |

*Primary Examiner*—Patrick R. Salce
*Assistant Examiner*—Jeffrey Sterrett
*Attorney, Agent, or Firm*—William W. Holloway

[57] ABSTRACT

A circuit for providing a constant current and a constant bias voltage is described. The circuit includes two paths coupled between a positive voltage supply $+V_S$ and a negative voltage supply $-V_S$. Each path inlcudes a Zener diode and a enhancement mode field effect transistor (FET) device (the FET device being coupled in a diode configuration) which are connected in series. Each path of the circuit further includes an FET device and an associated resistor combination, coupled in series with the Zener diode and the diode-coupled FET device. The FET device and the associated resistor function as a current source component. A gate terminal of each FET device of the current source component is coupled across the Zener diode and the diode-coupled FET device of the other circuit path. This cross-coupling between the two paths provides compensation, in addition to that provided by the Zener diode characteristics, for variations in circuit parameters, such as changes in the voltage supplies, thereby permitting a stable bias voltage to be generated.

13 Claims, 2 Drawing Sheets

BIAS VOLTAGE AND CONSTANT CURRENT SUPPLY CIRCUIT

BACKGROUND OF THE INVENTION

1. Field of the Invention

This invention relates generally to the regulation of the voltage and current characteristics of electrical circuits and, more particularly, to circuits providing a reference (or bias) voltage and/or providing a constant current source that are substantially independent of the power sources activating the circuit. The present invention uses enhanced mode FET devices to provide voltage and current control while being coupled to relatively high voltage supplies.

2. Description of the Related Art

Referring now to FIG. 1A, a prior art technique for providing a reference voltage is illustrated. The cathode of a Zener diode D1 is coupled to the positive voltage supply $+V_S$. The anode of the Zener diode D1 is coupled through resistor R1 to the cathode of Zener diode D2. The anode of Zener diode D2 is coupled to the negative voltage supply $-V_S$. The characteristics of a Zener diode, reverse biased, are such that the voltage across the Zener diode is essentially independent of the current flowing therethrough. Thus, a bias voltage relative to the positive supply terminal, $V_{BIAS+}$, and a bias voltage relative to the negative supply, $V_{BIAS-}$, are maintained that are relatively independent of fluctuations in the voltage supplies, the changes in the supply voltages being compensated for in the resistor R1. Because the voltage across a Zener diode is independent of the current therethrough only to a first approximation, improvements have been sought to increase the stability of the $V_{BIAS+}$ and $V_{BIAS-}$ bias voltages relative to fluctuations in the supply voltages.

The stability of the bias voltages can be improved, according to the prior art, by the circuit shown in FIG. 1B. In FIG. 1B, the resistor R1 is replaced by the n-channel junction FET device Q1 with a resistor R2 in the gate-source circuit, the gate of FET device Q1 being coupled to the cathode of Zener diode D2. The FET device/resistor combination forms a constant current source which, when combined with the constant voltage characteristics of the Zener diodes, provides increased stability for the bias voltages. Despite the increased stability of the bias voltage $V_{BIAS+}$ and $V_{BIAS-}$, greater stability of the bias voltages against parameter changes, such as fluctuations in supply voltage levels, has been sought. In addition, the depletion mode transistor have limited voltage handling capacity and, at the present time, are relatively expensive.

A need has therefore been felt for apparatus and method for increasing the stability of bias voltages capable of implementation with high voltage supplies that do not have the disadvantages of the prior art circuits and do not require depletion mode transistor devices.

FEATURES OF THE INVENTION

It is an object of the present invention to provide an improved circuit for supplying bias voltages.

It is a feature of the present invention to provide an improved circuit for increasing the isolation of bias voltages produced therefrom from fluctuations in the circuit parameters.

It is another feature of the present invention to provide a circuit activated by a high voltage supply that provides stable bias voltages.

It is still another feature of the present invention to provide an improved constant current source.

SUMMARY OF THE INVENTION

The aforementioned and other features are accomplished, according to the present invention, by providing a bias voltage circuit having two current paths. Each current path includes a Zener diode coupled in series with an enhanced mode FET device connected in a diode configuration, the Zener diode and diode-coupled FET device being coupled in series with an FET device/resistor combination current source. The Zener diode in each circuit path reduces the voltage variation resulting from changes in current through the Zener diode. The diode-coupled FET device provides threshold voltage and temperature compensation. The FET device/resistor current source reduces the current fluctuations resulting from changes in voltage across the Zener diode/diode-coupled FET device combination. By interconnecting the two circuit paths, the FET device/resistor combination reduces the voltage variation across the Zener diode/diode-coupled FET device. The voltage across the Zener diodes of each current path remains substantially constant. The bias voltage circuit can also be used as a constant current source.

These and other features of the present invention will be understood upon reading of the following description along with the drawings.

DESCRIPTION OF THE PREFERRED EMBODIMENT

1. Detailed Description of the Figures

Figure 1A:
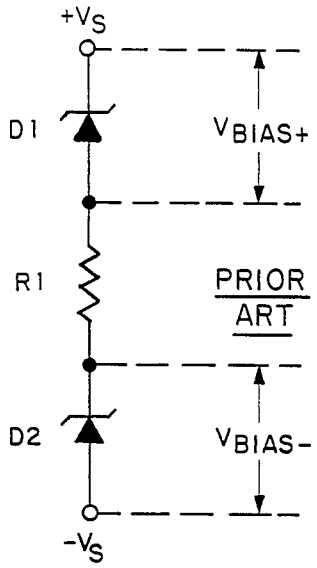
FIG. 1A and FIG. 1B illustrate circuits for providing bias voltages according to the prior art.
Figure 1B:
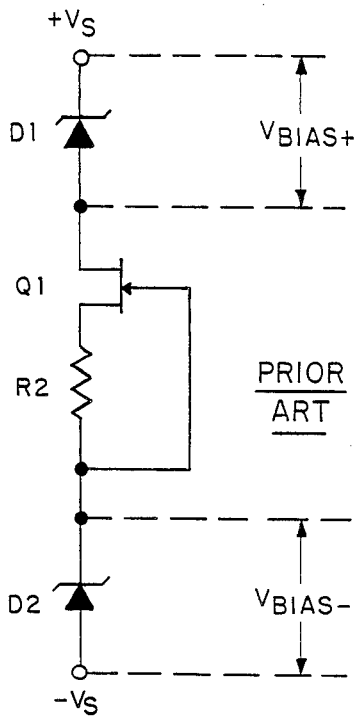
Figure 2:
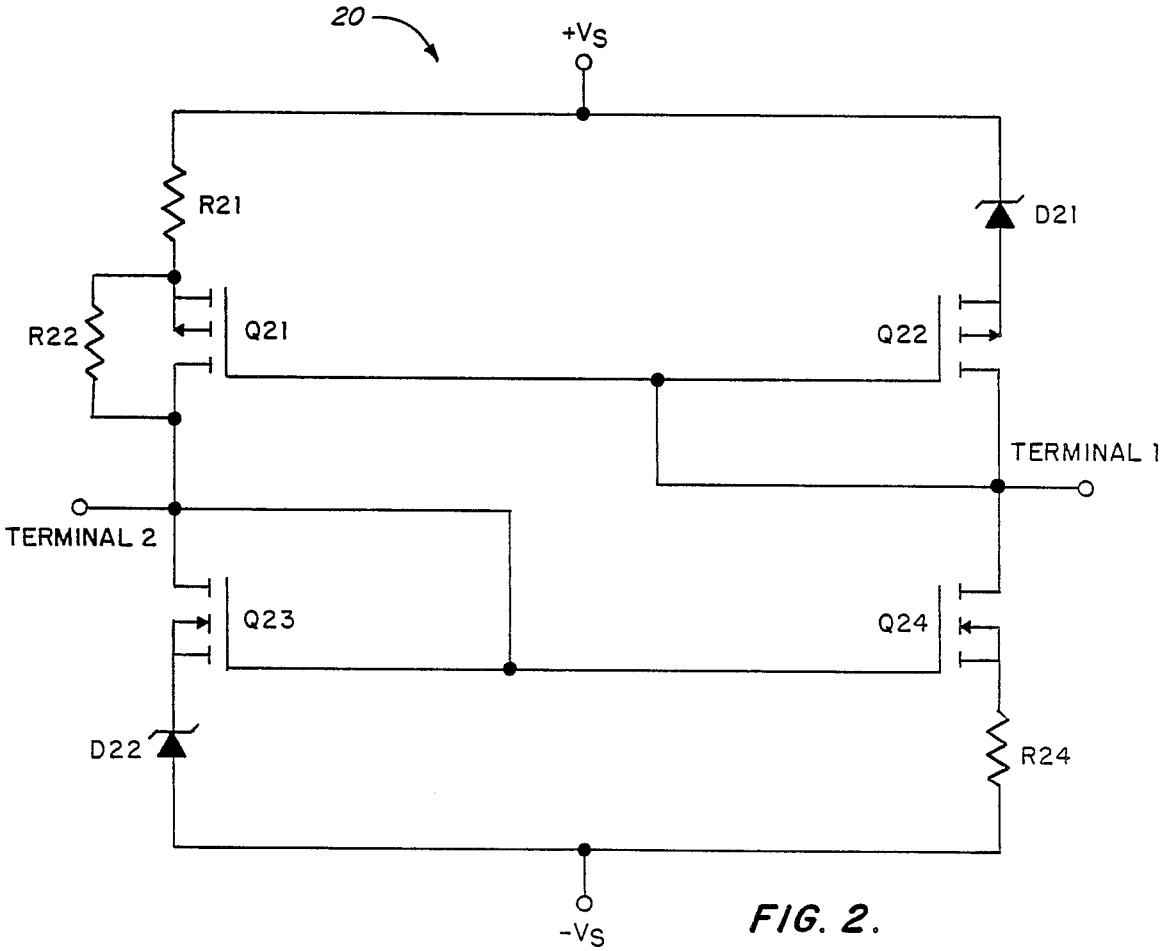
FIG. 2 is a circuit diagram of the circuit for providing stable bias voltages according to the present invention.

Referring now to FIG. 2, the circuit for providing stable bias voltage levels of the present invention is shown. The positive supply $+V_S$ is coupled to a cathode terminal of Zener diode D21 and through resistor R21 to a first terminal of resistor R22 and a source terminal of enhanced mode p-channel FET device Q21. The drain terminal of FET device Q21 is coupled to the second terminal of resistor R22, to a drain terminal of enhanced mode n-channel FET device Q23, to a gate terminal of FET device Q23, to a gate terminal of enhanced mode n-channel FET device Q24 and to output terminal 2. The anode terminal of Zener diode D21 is coupled to a source terminal of enhanced mode p-channel FET device Q22, while the gate terminal of FET device Q22 is coupled to the gate terminal of FET device Q21, to the drain terminal of FET device Q22, to output terminal 1 and to a drain terminal of FET device Q24. The source terminal of FET device Q24 is coupled through the resistor R24 to the negative voltage supply $-V_S$. The source terminal of FET device Q23 is coupled to a cathode terminal of Zener diode D22, while the anode terminal of Zener diode D22 is coupled to the negative voltage supply $-V_S$.

Figure 3:
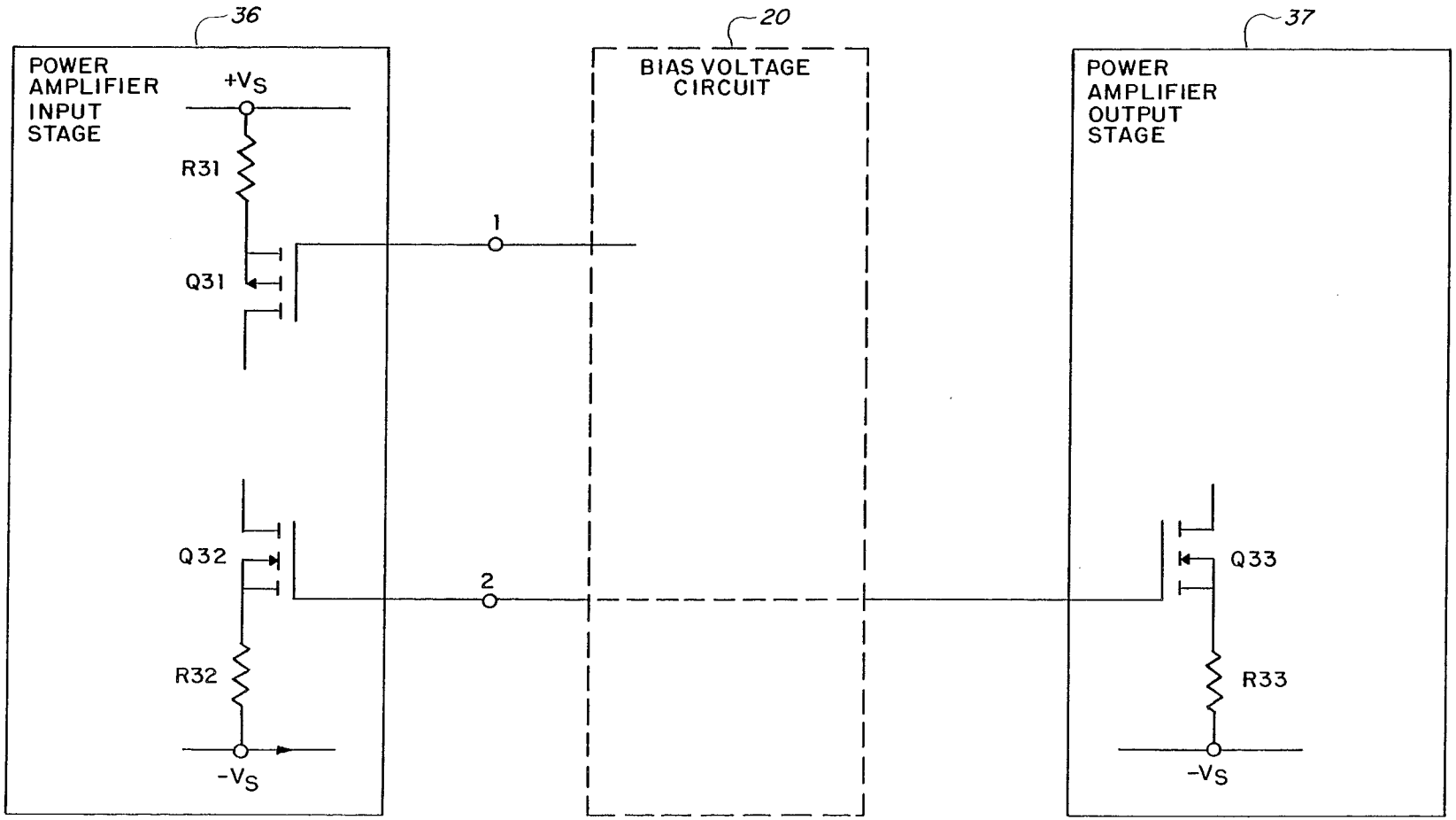
FIG. 3 illustrates how the bias voltage levels of the present invention can be applied to stages of an associated circuit, such as a power amplifier.

Referring next to FIG. 3, the coupling of the voltage bias circuit 20 of FIG. 2 to an associated circuit exemplified by a power amplifier input stage 36 and the power amplifier output stage 37 is illustrated. The output terminal 1 of FIG. 2 is coupled to the input stage of a power amplifier by means of the gate terminal of enhanced mode p-channel FET device Q31, the source terminal of FET device Q31 being coupled to the $+V_S$ supply terminal through a resistor R31. The output terminal 2 of FIG. 2 is coupled to the input stage of the power amplifier by means of the gate terminal of enhanced mode n-channel FET device Q32, the source terminal of FET device Q32 being coupled to the $-V_S$ supply terminal through resistor R32. The bias voltage circuit of FIG. 2 is coupled to the power amplifier output stage 37 by coupling output terminal 2 of FIG. 2 to gate terminal of enhanced mode n-channel FET device Q33, the source terminal of FET device Q33 coupled to the $-V_S$ supply terminal through resistor R33.

2. Operation of the Preferred Embodiment

Referring to FIG. 2, the operation of the bias circuit can be understood in the following manner. The bias circuit consists of two current paths that are interconnected. The Zener diodes in each circuit path provide a generally constant voltage for a wide range of currents therethrough. To minimize the excursions from an equilibrium value of the current through the Zener diode and therefore reduce the fluctuations in voltage across the Zener diodes, a constant current source, provided by the FET device/resistor combination (Q21/R21 and Q24/R24), is included in each path. The current source combination has a gate terminal with the voltage across the Zener diode and diode-coupled FET device of the other current path coupled thereto. The constant current source, in response to fluctuations across the Zener diode/diode-coupled FET device of the other current path, reduces the effect of circuit parameter fluctuations by providing a more constant current through the Zener diode in the associated path. For example, in FIG. 2, when the difference between $+V_S$ and $-V_S$ increases, the voltage across the combination of resistor R21 and FET device Q21 is increased, maintaining the voltage across FET device Q23 and Zener diode D22 substantially constant and enhancing the properties of these two devices that already minimize the fluctuations in voltage across the Zener diode and the constant current source. The voltage at output terminal 2 is therefore relatively isolated from changes in circuit parameters. The diode-coupled FET devices are used to compensate for threshold voltage and temperature dependent fluctuations in the associated FET device, i.e., FET device Q22 compensates for these parameters in FET device Q21 while these parameters in FET device Q24 are compensated for FET device Q23.

Referring once again to FIG. 2 and FIG. 3, the configuration is designed to reproduce the voltage of the Zener diode across the associated source resistor in the coupled circuit exemplified as a power amplifier stage. For example, the voltage across Zener diode D22 is duplicated across resistor R32 and across resistor R33. Resistors R32 and R33 and the associated FET devices (Q32 and Q33) are used as constant current sources in the coupled power amplifier stages. Similarly, the voltage across Zener diode D21 is duplicated across resistor R31, and the resistor R31 and FET device Q31 function as a current source. The positioning of FET device Q23 permits similar voltage drops to be provided across FET device Q23 and Q32 (or Q33), thereby replicating the Zener voltage across the bias resistor. In the preferred embodiment, the FET devices Q23, Q24, Q32 and Q33 are selected from the same device batch to minimize the variation in the device characteristics and more accurately impose the Zener diode bias voltage across the associated resistors, the diode-coupled FET devices providing threshold voltage and temperature variation compensation for the associated FET device in the power amplifier stage. The Zener diode D22 is used to provide a reference voltage relative to the negative voltage supply $-V_S$. The Zener diode D21 is used to provide a reference or bias voltage relative to the positive voltage supply $+V_S$.

In the preferred embodiment, the FET devices are enhanced mode FET devices. The enhanced mode devices can operate at higher voltages and, at the present time, are relatively inexpensive. However, it will be clear that other semiconductor devices can be used in a similar bias circuit.

The resistor R22 of FIG. 2 has the function of insuring that, when voltage is applied between the positive and negative voltage supply, the bias circuit can not remain in an inoperative state.

As will be clear to those skilled in the art, the current through the two paths is maintained essentially constant as a result of the coupling of the two paths. Thus the total current though the bias circuit is maintained substantially constant independent of the voltage level between the positive voltage supply $+V_S$ and the negative voltage supply $-V_S$. Therefore, a different application of the circuit of the present invention is that of a constant current source.

The foregoing description is included to illustrate the operation of the preferred embodiment and is not meant to limit the scope of the invention. The scope of the invention is to be limited only by the following claims. From the foregoing description, many variations will be apparent to those skilled in the art that would yet be encompassed by the spirit and scope of the invention.

What is claimed is:

1. A circuit for providing a reference or bias voltage, said circuit comprising:

a circuit path including:

a first Zener diode for providing said reference voltage, a first parameter compensation device coupled in series with said first Zener diode;

first amplifier means coupled in series with said first Zener diode and said first parameter compensation device, and feedback means receiving a control signal from said first Zener diode and said coupled first parameter compensation device and applying a feedback signal to said first amplifier means for maintaining a voltage level across said first Zener diode and first parameter compensation device substantially constant;

wherein said feedback means includes:

a second Zener diode for providing a second reference voltage;

a second parameter compensation device coupled in series with said second Zener diode; and second amplifier means coupled in series with said second Zener diode and said second parameter compensation device, said control signal applied to a control terminal of said second amplifying means.

2. The circuit for providing a reference or bias voltage of claim 1 wherein said first Zener diode is coupled to a first voltage supply level and wherein said second Zener diode is coupled to a second voltage level.

3. The circuit for providing a reference or bias voltage of claim 2 wherein said first amplifying means and said second amplifying means and said first parameter compensation device and said second parameter compensation device include enhanced mode FET devices.

4. The circuit for providing a reference or bias voltage of claim 3 wherein said first parameter compensation device and said second parameter compensation device are first and second constant current FET devices each having a gate terminal coupled to a drain terminal.

5. The circuit for providing a reference or bias voltage of claim 4 wherein said first amplifying means and said second amplifying means are first and second enhanced mode amplifying FET devices each having a resistor coupled to a source terminal.

6. The circuit for providing a reference or bias voltage of claim 6 wherein a startup resistor is coupled between a source terminal and a drain terminal of said first FET.

7. The circuit of claim 5 wherein said circuit is a constant current source circuit.

8. A circuit for providing a reference or bias voltage, said circuit also providing a constant current device, said circuit comprising:

a circuit path including;

a first constant voltage component for providing a voltage source, a first constant current component coupled in series with said first constant voltage component, and first amplifier means coupled in series with said first constant voltage component and said first constant voltage component; and feedback means receiving a control signal determined by a voltage across said first constant voltage component and first constant current component, said feedback means responsive to said control signal for applying a feedback signal to said first amplifier means for maintaining a voltage level across said first constant voltage component and said first constant current component substantially constant.

9. The circuit for providing a reference voltage or constant current device of claim 1 wherein said feedback means includes:

a second constant voltage component;

a second constant current component coupled in series with said second constant voltage component; and second amplifier means coupled in series with said second constant voltage component and said second constant current component, said feedback means being coupled in parallel with said circuit path, wherein said control signal is applied to said second amplifier means for maintaining a voltage across said second constant voltage component and said second constant current component substantially constant, said feedback signal being determined by a voltage across said second constant voltage component and said second constant current component.

10. The circuit for providing a reference voltage or constant current device of claim 9 wherein said first and second constant voltage component are Zener diodes, wherein said first and said second constant current components are FET devices each having a gate terminal coupled to a drain terminal and wherein said first and said second amplifier means are FET devices.

11. A circuit coupled between a first and a second terminal for providing a reference voltage or for providing a constant current source, the circuit comprising:

a first Zener diode having an anode coupled to said first terminal;

a first FET device having a source terminal coupled to a cathode of said first Zener diode wherein said first FET device has a gate terminal coupled to a drain terminal of said first FET device and to a first output terminal;

a first resistor;

a second FET device having a drain terminal coupled to a drain terminal of said first FET device, a source terminal of said second FET device coupled through said first resistor to said second terminal;

a second resistor;

a third FET device having a source terminal coupled through said second resistor to said first terminal, a gate of said third FET device coupled to said gate terminal of said first FET device;

a fourth FET device having a drain terminal coupled to a drain terminal of said third FET device, to a gate terminal of said fourth FET device, to a gate terminal of said second FET device and to a second output terminal; and a second Zener diode coupled having a cathode coupled to said second terminal and an anode terminal coupled to a source terminal of said fourth FET device.

12. The circuit of claim 11 wherein said first and said third FET devices are enhanced n-channel FET devices and said second and fourth FET devices are enhanced p-channel FET devices.

13. The circuit of claim 12 further comprising a startup resistor coupled between said source terminal and said drain terminal of said second FET device.

* * * * *